US008763176B2

(12) United States Patent
Lim et al.

(10) Patent No.: US 8,763,176 B2
(45) Date of Patent: Jul. 1, 2014

(54) LIFT DEVICE INCLUDING RING-SHAPED DRIVING UNIT

(75) Inventors: Do Hyung Lim, Hwaseong (KR); Kyeoung Jin Chun, Uiwang (KR)

(73) Assignee: Korea Institute of Industrial Technology, Cheonan (KR)

( * ) Notice: Subject to any disclaimer, the term of this patent is extended or adjusted under 35 U.S.C. 154(b) by 45 days.

(21) Appl. No.: 13/636,362

(22) PCT Filed: Mar. 28, 2011

(86) PCT No.: PCT/KR2011/002107

§ 371 (c)(1),
(2), (4) Date: Sep. 21, 2012

(87) PCT Pub. No.: WO2011/122809

PCT Pub. Date: Jun. 10, 2011

(65) Prior Publication Data

US 2013/0007959 A1 Jan. 10, 2013

(30) Foreign Application Priority Data

Mar. 29, 2010 (KR) ..... 10-2010-0028171

(51) Int. Cl.
*A61G 7/10* (2006.01)

(52) U.S. Cl.
CPC ..... *A61G 7/1019* (2013.01); *A61G 2203/14* (2013.01); *A61G 7/1057* (2013.01); *A61G 2200/32* (2013.01); *A61G 7/1046* (2013.01)
USPC ..... 5/83.1; 5/607; 5/611; 345/156; 345/161

(58) Field of Classification Search
USPC ..... 5/611, 83.1, 607; 345/156–184
See application file for complete search history.

(56) References Cited

U.S. PATENT DOCUMENTS

| | | | | |
|---|---|---|---|---|
| 3,394,933 | A * | 7/1968 | Benoit | 482/67 |
| 3,790,974 | A * | 2/1974 | Johansson | 5/83.1 |
| 3,940,808 | A * | 3/1976 | Petrini | 5/83.1 |
| 4,574,410 | A | 3/1986 | Lassmann et al. | |

(Continued)

FOREIGN PATENT DOCUMENTS

| | | | |
|---|---|---|---|
| JP | 05-031141 | A | 2/1993 |
| JP | 06-327727 | A | 11/1994 |

(Continued)

*Primary Examiner* — William Kelleher
*Assistant Examiner* — Myles Throop
(74) *Attorney, Agent, or Firm* — Patent Office of Dr. Chung Park

(57) ABSTRACT

There is disclosed a lift device including a base frame; a main frame comprising a fixing member longitudinally formed in an up and down direction, coupled to the base frame, and a movable member movably provided in an up and down direction; a bed unit connected to the movable member, positioned in front of the main frame; a operation unit having an end connected to the movable member or the bed unit and the other end extended forwardly, with a ring-shaped operation control part provided in the other end thereof to put a user's finger thereon; and a driving unit to move the movable member upwardly based on input of the operation control part, wherein the operation control part comprises an upper input means positioned in an inner top surface thereof to upwardly move the movable member based on an input signal and a lower input means position in an inner bottom surface thereof to downwardly move the movable member based on an input signal.

8 Claims, 12 Drawing Sheets

(56) References Cited

U.S. PATENT DOCUMENTS

| | | | | |
|---|---|---|---|---|
| 4,875,555 | A | 10/1989 | Johansson et al. | |
| 4,890,853 | A * | 1/1990 | Olson | 280/87.021 |
| 5,230,113 | A * | 7/1993 | Foster et al. | 5/608 |
| 6,597,347 | B1 * | 7/2003 | Yasutake | 345/173 |
| 6,826,793 | B2 * | 12/2004 | Tekulve | 5/618 |
| 7,480,600 | B2 * | 1/2009 | Massie et al. | 703/6 |
| 7,581,605 | B2 * | 9/2009 | Caspi et al. | 180/9.1 |
| 8,605,036 | B1 * | 12/2013 | Kelly | 345/169 |
| 8,681,101 | B1 * | 3/2014 | Haney et al. | 345/161 |
| 2006/0012567 | A1 * | 1/2006 | Sicklinger | 345/157 |
| 2007/0067905 | A1 * | 3/2007 | Wilder | 5/83.1 |
| 2012/0297542 | A1 * | 11/2012 | Chun et al. | 5/611 |
| 2013/0007957 | A1 * | 1/2013 | Chun et al. | 5/87.1 |
| 2014/0085177 | A1 * | 3/2014 | Lyons et al. | 345/156 |

FOREIGN PATENT DOCUMENTS

| | | | |
|---|---|---|---|
| JP | 09-028733 | A | 2/1997 |
| JP | 2004-195248 | A | 7/2004 |
| KR | 10-2001-0105635 | A | 11/2001 |
| KR | 10-2005-0119986 | A | 12/2005 |
| KR | 10-0619432 | B1 | 9/2006 |
| KR | 10-2008-0053342 | A | 6/2008 |
| KR | 10-0896817 | B1 | 5/2009 |
| WO | 2007-004423 | A2 | 4/2007 |
| WO | 2007-044231 | A2 | 4/2007 |

* cited by examiner

LIFT DEVICE INCLUDING RING-SHAPED DRIVING UNIT

CROSS-REFERENCE TO PRIOR APPLICATIONS

This application is a national Stage Patent Application of PCT International Patent Application No. PCT/KR2011/002107, filed on Mar. 28, 2011 under 35 U.S.C. §371, which claims priority of a Korean Patent Application No. 10-2010-0028171, filed on Mar. 29, 2010, which is all hereby incorporated by reference in their entirety.

TECHNICAL FIELD

Embodiments of the invention may relate to a movable lift device, more particularly, to a movable lift device of which intuitive operation and safe transfer can be performed.

BACKGROUND

There are many patients and seniors stay in bed in hospitals or skilled nursing facilities, because they are unable to move for themselves. Occasionally, patients and seniors have to be moved out of beds for treatment, baths or specific purposes. In those cases, it is hard and uncomfortable for a carer to lift a patient or sensor directly. Especially, it might be even impossible for a carer with a weak muscular strength to lift such a patient or sensor directly. In addition, some patients have their physical parts treated carefully and if possible, it is necessary to keep the state where such a patient is staying in bed. In that case, a lift device can be used.

However, a conventional lift device has simple kinds of driving methods used when transferring a patient. Accordingly, it is difficult to make the movement desired by a user.

Also, when operating the lift device, there is little mutual relation between the movement of the lift device and an operation control part enough to deteriorate intuition and there is a disadvantage of a long time taken to make the user to get used to operation of the lift device.

The user operates the lift device without changing the position, regardless of the movement of the transferred patient, and there is another disadvantage of deteriorated efficiency in recognizing the state of the patient. Accordingly, the patient's safety fails to be secured sufficiently.

In addition, it is difficult to operate the lift device to be driven as far as the user desires. For example, when the patient complains pain even at slight shaking of the lift device, the driving speed of the lift device is uniform and the patient cannot help having pain. Even when the patient has to be moved fast or quite gently, such fast or gentle movement cannot be made.

Accordingly, a lift device capable of solving the problems mentioned above to improve user convenience and patient safety is required.

DISCLOSURE

Technical Problem

To solve the problems, an object of the present invention is to provide a lift device that is operable by anyone easily by allowing a user to recognize an operation method intuitively.

Another object of the present invention is to provide a lift device that allows even a user to move along the driving thereof, while intuitively identifying a patient's movement made by the driving of the lift device.

A further object of the present invention is to provide a lift device that can realize various driving types thereof according to an input signal of a plurality of input units provided in a ring-shaped operation unit.

The objects of the present invention mentioned above are not limited thereto and other objects can be clearly understood from the detailed description herewith by people skilled in the art to which the present invention pertains.

Technical Solution

To achieve these objects and other advantages and in accordance with the purpose of the embodiments, as embodied and broadly described herein, a lift device includes a base frame; a main frame comprising a fixing member longitudinally formed in an up and down direction, coupled to the base frame, and a movable member movably provided in an up and down direction; a bed unit connected to the movable member, positioned in front of the main frame; a operation unit having an end connected to the movable member or the bed unit and the other end extended forwardly, with a ring-shaped operation control part provided in the other end thereof to put a user's finger thereon; and a driving unit configured to move the movable member upwardly based on input of the operation control part, wherein the operation control part comprises an upper input means positioned in an inner top surface thereof to upwardly move the movable member based on an input signal and a lower input means position in an inner bottom surface thereof to downwardly move the movable member based on an input signal.

The lift device further comprises a first auxiliary driving unit configured to rotate the main frame and the main frame may be rotatably coupled to the base frame with respect to an up and down direction shaft, and and the operation control part may include a front input means positioned in an inner front surface thereof to rotate the main frame in a left or right direction based on an input signal and a rear input means positioned in an inner rear surface thereof to rotate the main frame in the reverse direction of the rotational direction corresponding to the front input means based on an input signal.

The bed unit may include a connecting member connected to the movable member; a sliding member slidingly coupled to the connecting member in a longitudinal direction thereof; and a bed part fixed to the sliding member, and the operation control part may include a front input means positioned in an inner front surface thereof to slide the sliding member forwardly based on an input signal; and a rear input means positioned in an inner rear surface thereof to slide the sliding member backwardly based on an input signal.

The base frame may include a plurality of wheels, and the operation control part comprises a front input means positioned in an inner front surface thereof to forwardly move the base frame based on an input signal; and a rear input means positioned in an inner rear surface thereof to backwardly move the base frame based on an input signal.

The operation control part may include a pair of left and right operation parts spaced from each other in a right and left direction, and when signals are input to the upper input means of the left operation part and the right operation part simultaneously, the movable member may be upwardly moved, and when signals are input to the lower input means thereof simultaneously, the movable member may be downwardly moved.

The bed unit may include a connecting member connected to the movable member and a bed part fixed to the connecting member, and the bed part may include a main bed part fixed to the connecting member; a left bed part rotatably coupled to a left side of the main bed part with respect to a back and forth direction shaft; and a right bed part rotatably coupled to a right side of main bed part with respect to the back and forth direction shaft, and the left bed part may be rotated in an up and down direction based on input of an upper input means or lower input means of the left operation part, and the right bed part may be rotated in the up and down direction based on input of an upper input means or lower input means of the right operation part.

The main frame may be rotatably coupled to the base frame with respect to an up and down direction shaft, and the bed unit may include a connecting member connected to the movable member; a sliding member slidingly coupled to the connecting member in a back and forth direction; and a bed part fixed to the sliding member, and the main frame may be rotated in a right or left direction based on a signal input to an upper or lower input means provided in one of left and right operation parts, and the sliding member may be sliding in a back and forth direction based on a signal input to an upper or lower input means provided in the other one of the left and right operation parts.

The base frame may include a left moving part and a right moving part having a plurality of wheels, respectively, and the left operation part and the right operation part may include front input means positioned in inner front surfaces of the left and the right operation parts, respectively, and rear input means positioned in inner rear surfaces of the left and right operation parts, respectively, and the left operation part may be forwardly or backwardly moved based on a signal input to the front or rear input means of the left operation part, and the right operation part may be forwardly or backwardly moved based on a signal input to the front or rear input means of the right operation part.

The upper input means, the lower input means, the front input means and the rear input means may include strain gages, respectively, to receive an external pressure.

Advantageous Effects

The embodiments have following advantageous effects. According to the invention, First, the control part is driven together with the lift device or the bed where the patient is lying. The user operating the control part may operate the lift device, while moving along the driving of the lift device or the driving of the bed. Accordingly, the user may move the patient safely, while checking the patient's movement intuitively.

Second, the control part is in communication with the driving of the lift device and it may maintain a predetermined distance from the patient's position. Accordingly, the patient's state can be checked constantly and the user may drive the lift device, considering the patient's convenience or safety.

Third, the plurality of the input means may be provided in the ring-shaped control part and various driving of the lift device may be realized by combination of the signals input to the input means. Accordingly, various driving methods of the lift device may be realized simply, even without the complex operation device.

The effects of the present invention are not limited by the effects mentioned above and other effects not mentioned above can be clearly understood from detailed description which will be described below by anyone skilled in the art to which the present invention pertains.

BEST MODE

Figure 1:
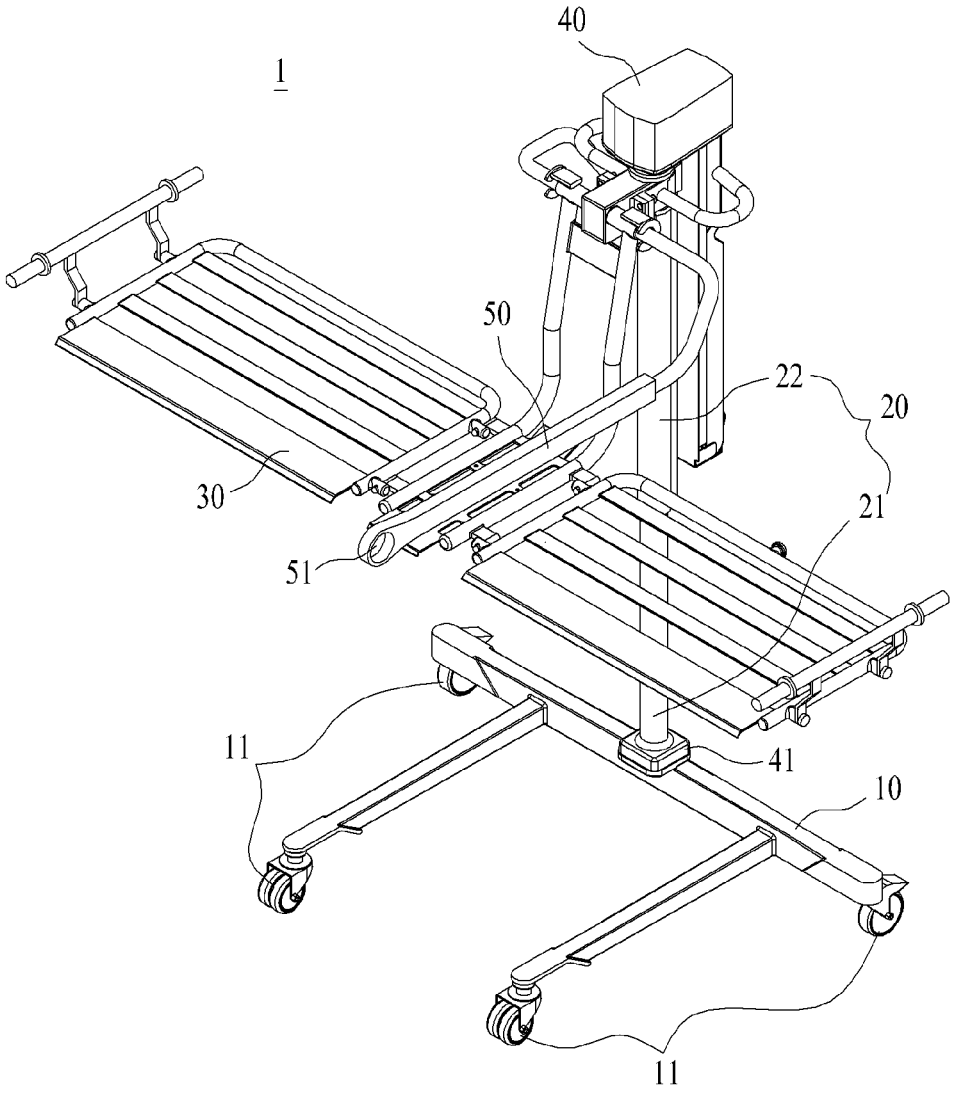
FIG. 1 is a perspective view illustrating a lift device according to a first embodiment of the present invention.

Embodiments of the present invention will be described in detail in reference to the accompanying drawings and contents disclosed in the drawings and the present invention is not limited to the embodiments. Reference may now be made in detail to specific embodiments, examples of which may be illustrated in the accompanying drawings. Wherever possible, same reference numbers may be used throughout the drawings to refer to the same or like parts.

Figure 2:
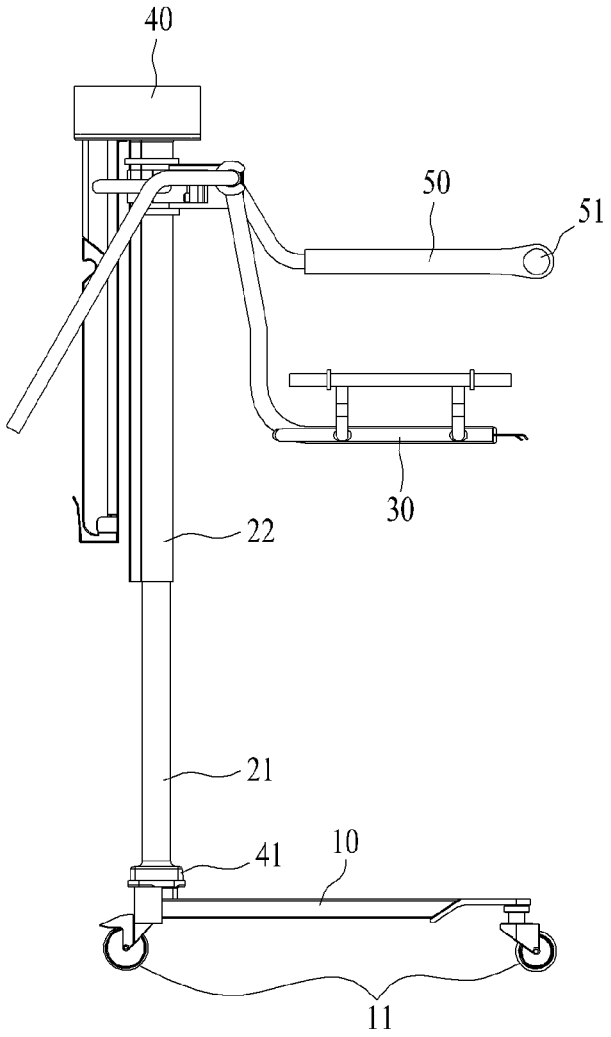
FIG. 2 is a side view illustrating the lift device according to the first embodiment of the present invention.
Figure 5:
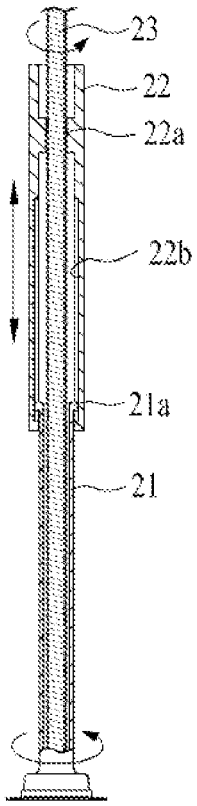
FIG. 5 is a sectional view of a main frame according to the first embodiment of the present invention.

FIG. 1 is a perspective view of a lift device 1 according to a first embodiment of the present invention and FIG. 2 is a side view of the lift device 1 according to the first embodiment of the present invention. FIG. 5 is a sectional view of a main frame 20 according to the first embodiment of the present invention.

Referring to FIGS. 1 and 2, the lift device 1 according to the first embodiment includes a base frame 10, a main frame 20, a bed unit 30, a driving unit 40 and an operation unit 50. Referring to FIG. 5, the main frame 20 according to the first embodiment includes a fixing member 21, a movable member 22 and a screw member 23.

The base frame 10 may be formed in various shapes only if it is capable of supporting the lift device 1 securely. Specifically, according to this embodiment, a main support leg is longitudinally formed in a horizontal direction. A pair of auxiliary legs may be longitudinally formed in a back and forth direction to be coupled each other in symmetry. A plurality of wheels 11 may be provided in the main support leg and the auxiliary legs.

The main frame 20 is longitudinally formed in an up and down direction and it is rotatably coupled to the base frame 10 with respect to a vertical shaft. The main frame 20 includes the fixing member 21 coupled to the base frame 10 and the movable member 22 movably coupled to the fixing member 21 in a vertical direction in various methods.

Specifically, in the first embodiment, the fixing member 21 and the movable member 22 are pipe-shaped with an inserting hole formed therein. The fixing member 21 is inserted in the inserting hole of the movable member 22. The fixing member 21 and the inserting hole of the movable member are longitudinally formed, in communication with each other. The screw member 23 is rotatably inserted in the inserting hole in communication with the fixing member and a screw thread is formed in a circumference of the inserting hole.

Meanwhile, the fixing member 21 is rotatably coupled to a center of the main support leg of the base frame 10 with respect to the vertical shaft. A coupling projection 21*a* is formed in each side of an upper end of the fixing member 21 and a guide groove 22*b* is formed in an inner surface of the movable member 22 in a longitudinal direction to insert the coupling projection 21*a* therein. Also, the movable member 22 has a support projection 22*a* formed therein, corresponding to the screw thread of the screw member 23 to be connected with the screw member 23.

According to the connection structure mentioned above, the movable member 22 is movable in the vertical direction together with the rotation of the screw member 23 by a ball screw method. At this time, the coupling projection 21*a* is hooked to upper and lower ends of a guide groove 22*b*, such that the movable member 22 can move as far as the entire length of the guide groove 22*b*.

When the fixing member 21 is rotated with respect to the vertical shaft, the coupling projection 1*a* is rotated together to apply a predetermined force to a lateral surface of the guide groove 22*b*. Accordingly, the movable member 22 is also rotated together with the rotation of the fixing member 21.

The bed unit 30 is positioned in front of the main frame 20. accordingly, seen from the side, the lift device 1 is formed in a '⌐' shape (see FIG. 2). A predetermined area enough to have a sufficient rightward and leftward length is formed to allow a human body to lie on the bed unit. The bed unit 30 is connected to the movable member 22. As the movable member 22 is moving in the vertical direction, the bed unit is moving in the vertical direction. The bed unit 30 is also rotated in a right and left direction with respect to the main frame 20 along the rightward and leftward rotation of the fixing member 21.

The driving unit 40 includes one or more driving part for driving a specific one of components composing the lift device 1. specifically, the driving unit 40 provided beyond the main frame 20 according to the first embodiment rotates the screw member 22 to move the movable member 22 in the vertical direction by the ball screw method. A first auxiliary driving unit 41 rotates the fixing member 21 in the right and left direction with respect to the vertical shaft. The driving unit 40 and the first auxiliary driving unit 41 may be various types of motors.

An end of the operation unit 50 is connected to the movable member 22 or the bed unit 30 and the other end thereof is extended forwardly. The ring-shaped operation control part 51 is provided in the other end of the operation unit 50 to allow the user to operate the lift device 1, using the finger positioned in a ring of the operation control part 51. A plurality of input means may be provided in a circumferential surface of the ring, which will be described later.

Specifically, an end of the operation unit 50 according to the first embodiment is connected to the movable member 22 and the other end thereof is extended in a forward direction of the bed unit 30. accordingly, the user may operate the operation control part 51 in front of the bed unit 30 positioned in front of the main frame 20 conveniently. The operation unit 50 may be vertically spaced apart a predetermined distance from a top of the bed unit 30 to secure a sufficient space where the human body is laid.

Moreover, the operation unit 50 may be rotatable in a vertical direction with respect to a right and left direction shaft. Accordingly, when the patient enters into the bed part 33, the operation unit 50 may be rotated upwardly and after the patient is lying down, the operation unit 50 is re-rotated downwardly again with the patient lying on the bed part 33. The operation unit 50 may be used as a handle held by the patient when the patient is moving.

In this embodiment, an end of the operation unit 50 is connected to the movable member 22. Accordingly, the operation unit 50 is moved upward and downwardly according to the upward and downward movement of movable member 22.

Generally, the patient who is not able to move about freely lies on the bed unit 30. At this time, the operation unit 50 is moving in the vertical direction along the movement of the bed unit 30, while maintaining a predetermined distance from the bed unit 30. In this instance, the user operating the operation control part 51 may control the height of the bed unit 30, while checking the current position of the patient intuitively. Accordingly, the user can figure out and understand the current situation of the patient well and he or she can take care of the patient safely and effectively. Also, the user can operate the operation control part 51, fitted to the patient's situation more intuitively and quickly.

Figure 3:
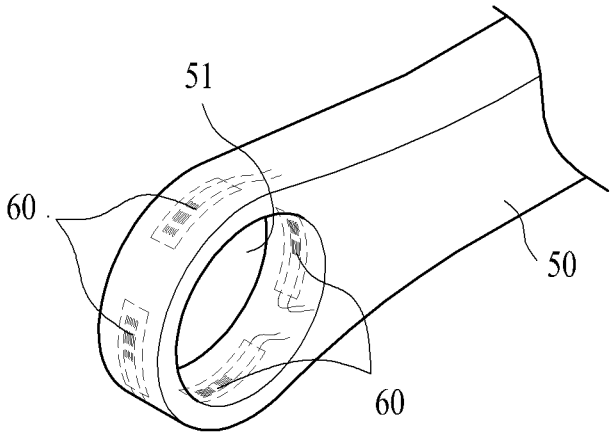
FIG. 3 is a perspective view illustrating a structure of an operation control part according to a first embodiment of the present invention.

FIG. 3 is a perspective view illustrating the structure of the operation control part 51 according to the first embodiment of the present invention.

Referring to FIG. 3, the operation control part 51 is formed in a ring shape and the plurality of the input means may be provided in upper, lower, front and back surfaces of an inner circumference of the ring. A strain gage 60 is attached to each of the input means and wires extended from strain gages 60 are omitted in the drawing for convenience sake.

As mentioned above, the operation control part 51 is provided in the other end of the operation unit 50 extended to be in front of the bed unit 30 in a ring shape. The ring shape may be changed into a polygonal shape. Especially, the ring shape can be a rectangular shape. If four input means are provided in up, down, back and forth portions inside the ring, it is not necessary to install the plurality of the input means spaced apart a predetermined distance from each other to prevent signals from being input to the plurality of the input means simultaneously.

In this embodiment, the operation control part 51 may be formed in a circular ring shape and the plurality of the input means may be provided in an inner circumferential surface of the operation control part 51. Types, shapes and positions of the input means can be various and the number of the input means is not limited.

According to the first embodiment, strain gages 60 are provided as the input means of the operation control part 51. Typically, such a strain gage 60 is attached to a structure and an electrical resistance of the strain gage 60 is varied when the structure is transformed. At this time, a variation rate is measured. In other words, the strain gage can measure a resistance value variable by an external pressure and it is possible to change an input valve according to the pressure applied by the user analogically. Again, when the user changes the pressure applied to the input means having the strain gages 60 attached thereto gradually, a driving speed of a driving part corresponding to the input means gradually.

In case that the operation control part 51 has a simple on-off operation method, it will be difficult to operate the lift device as far as the user desires to. For example, the driving speed of the conventional lift device is always uniform and the patient complaining pain cannot help but have pain when he or she is transferred. Also, in case that it is necessary to move the patient quickly or slightly, such quick or slight movement cannot be made. However, when the strain gages 60 provided in the operation control part 51 are operated gradually as mentioned above, the user may adjust the driving speed of the lift device based on the current state of the patient only to operate the lift device intuitively.

Specifically, in the first embodiment, the strain gages 60 are attached to upper, lower, front and rear surfaces of the inner circumference of the operation control part 51. The inner circumferential surface is slightly coated again to protect the surface thereof. Input is implemented by the user applying the pressure to a predetermined one of the input means positioned at a desired position with the finger put into the operation control part 51. A driving part corresponding to the predetermined one of the input means may be driven based on an input pressure value.

To prevent neighboring ones of the input means from being contacted simultaneously when the user places his or her finger on the desired one of the input means, the strain gages 60 may be spaced apart a predetermined distance from each other. Accordingly, the portions where input fails to be input may be provided between the input means in the operation control part 51.

Meanwhile, in this embodiment four input means may be provided. Optionally, the input means may be provided only in the upper, lower, front or rear surface of the inner circumference according to the driving method of the lift device.

Such the type of the strain gages 60 are used in the input means according to following embodiments which will be described later.

The driving in communication with the operation of the operation control part 51 corresponding to each of the embodiments will be described as follows.

Figure 4:
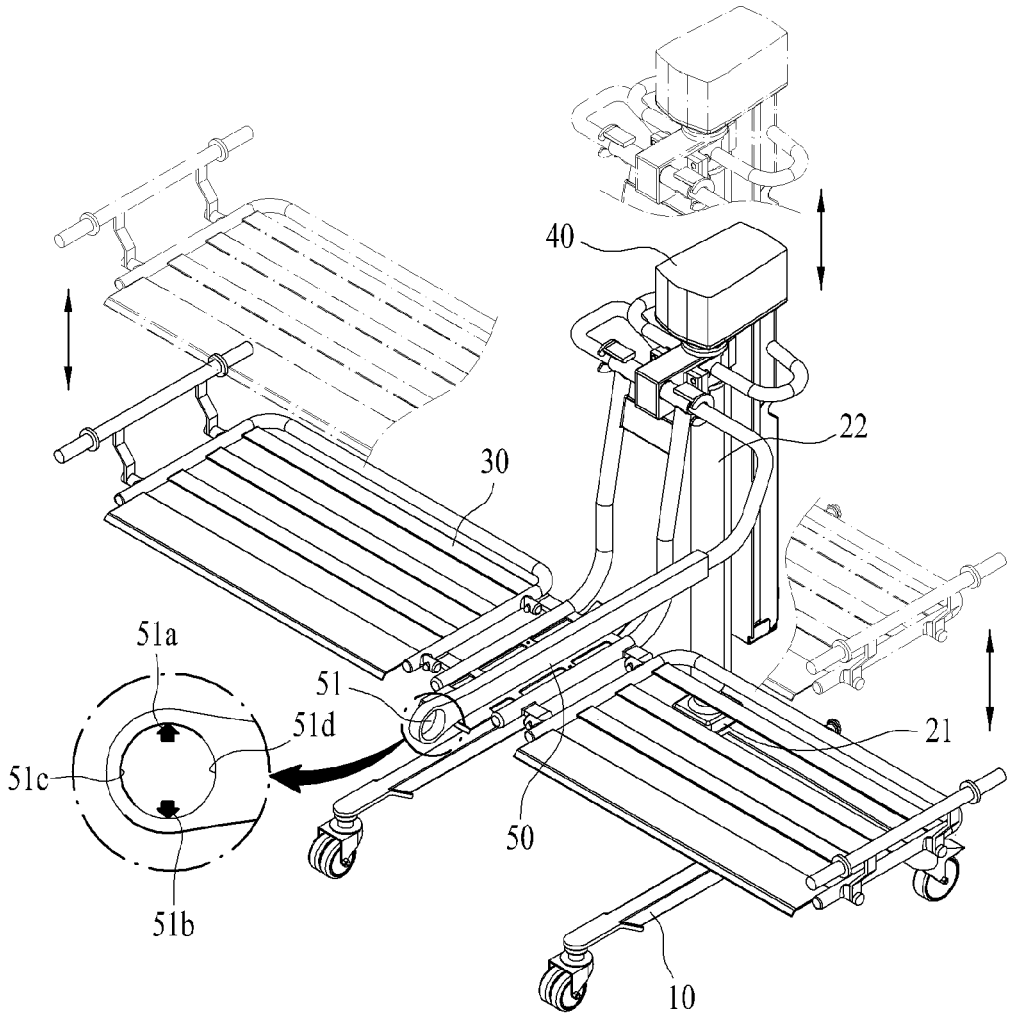
FIG. 4 is a perspective view illustrating a movable member moving a vertical direction based on the control of the operation control part according to the first embodiment of the present invention.
Figure 6:
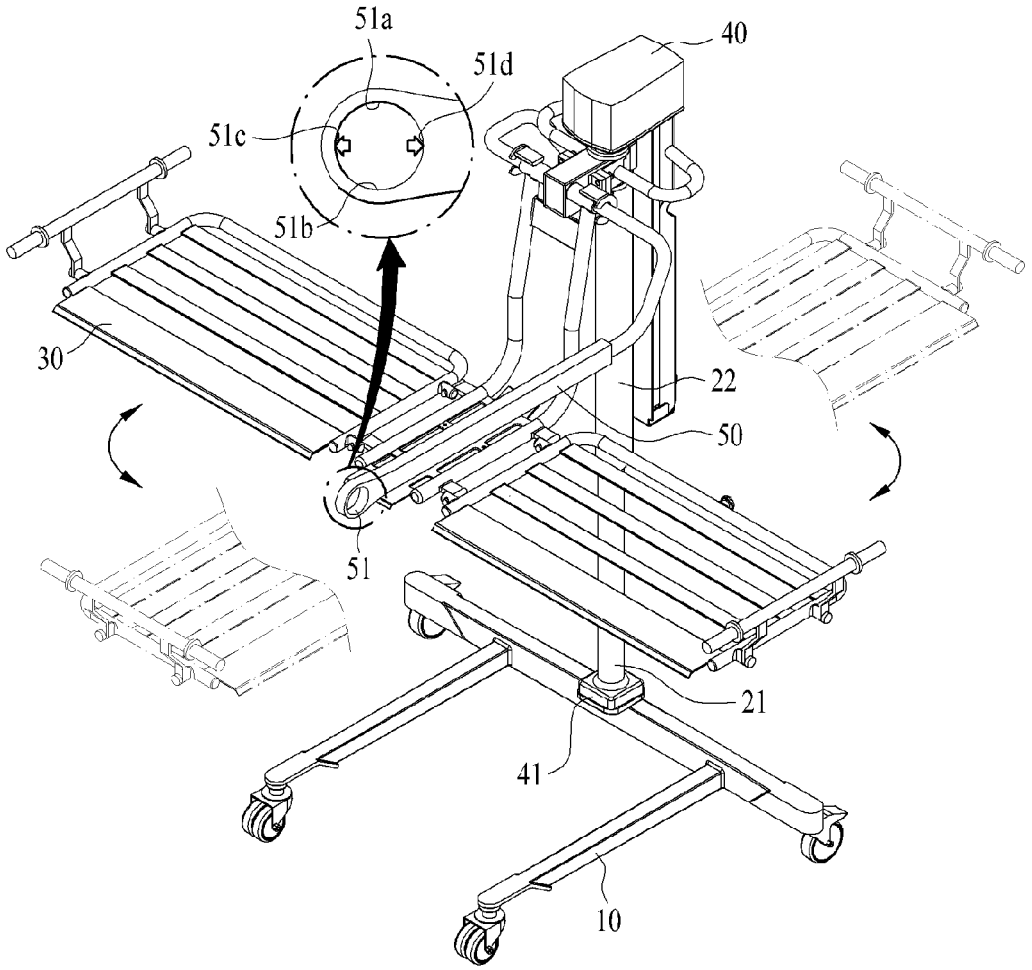
FIG. 6 is a perspective view illustrating the main frame rotating in a right and left direction with respect to a vertical shaft.

FIG. 4 is a perspective view illustrating a movable member moving a vertical direction based on the control of the operation control part according to the first embodiment of the present invention. FIG. 6 is a perspective view illustrating the main frame rotating in a right and left direction with respect to a vertical shaft.

Referring to FIGS. 4 to 6, the fixing member 21 and the movable member 22 are pipe-shaped with the inserting hole formed therein as mentioned above. The fixing member 21 is inserted in the inserting hole of the movable member 22 in a longitudinal direction. Accordingly, the fixing member 21 and the inserting hole of the movable member 22 are longitudinally formed in communication with each other. The screw member 23 having a screw thread formed there along is rotatably inserted in the inserting hole in communication with respect to the vertical direction shaft. Meanwhile, the mutual relation among the fixing member 21, the movable member 22 and the screw member 23 is the same as mentioned above and will be omitted accordingly.

The movable member 22 is vertically moved by the mutual relation according to a ball-screw method. The fixing member 21 is coupled to the center of the main support leg rotatably with respect to the vertical direction shaft.

The driving unit 40 moves the movable member 22 vertically by rotating the screw member 23 and the first auxiliary driving unit 41 rotates the fixing member in a right and left direction with respect to the vertical direction shaft.

According to the first embodiment, two types of driving methods are provided. The operation control part 51 includes four input means that consist of an upper input means 51*a*, a lower input means 51*b*, a front input mean 51*c* and a rear input means 51*d*.

Specifically, in the first embodiment as shown in FIG. 4, the vertical movement of the movable member 22 is corresponding to the upper input means 51*a* and the lower input means 51*b*. Accordingly, the user puts the finger on the upper input means 51*a* or the lower input means 51*b* to apply the pressure. The movable member 22, the bed unit 30 connected to the movable member 22 and the operation unit 50 are moved upwardly or downwardly by the pressure.

As shown in FIG. 6, the horizontal movement of the fixing member 21 is corresponding to the front input means 51*c* and the rear input means 51*d*. Accordingly, the user puts the finger on the front input means 51*c* or the rear input means 51*d* to apply the pressure. The fixing member, the movable member 22 connected to the fixing member 21, the bed unit 30 and the operation unit 50 are rotated rightward or leftward by the pressure together.

Also, the strain gages 60 are used in the input means, respectively. The driving speed is variable in proportion to the volume of the pressure applied by the user. That is commonly applied to all of the embodiments and will be omitted in following embodiments accordingly.

Meanwhile, as mentioned above, the operation control part 51 may include only the upper input means 51*a* and the lower input means 51*b* or the front input means 51*c* and the rear input means 51*d*. In this instance, two input means may be provided in upper and lower surfaces or front and rear surfaces in the operation control part 51. Each of the two input means is formed larger than each of four input means, in case four input means are provided.

Figure 7:
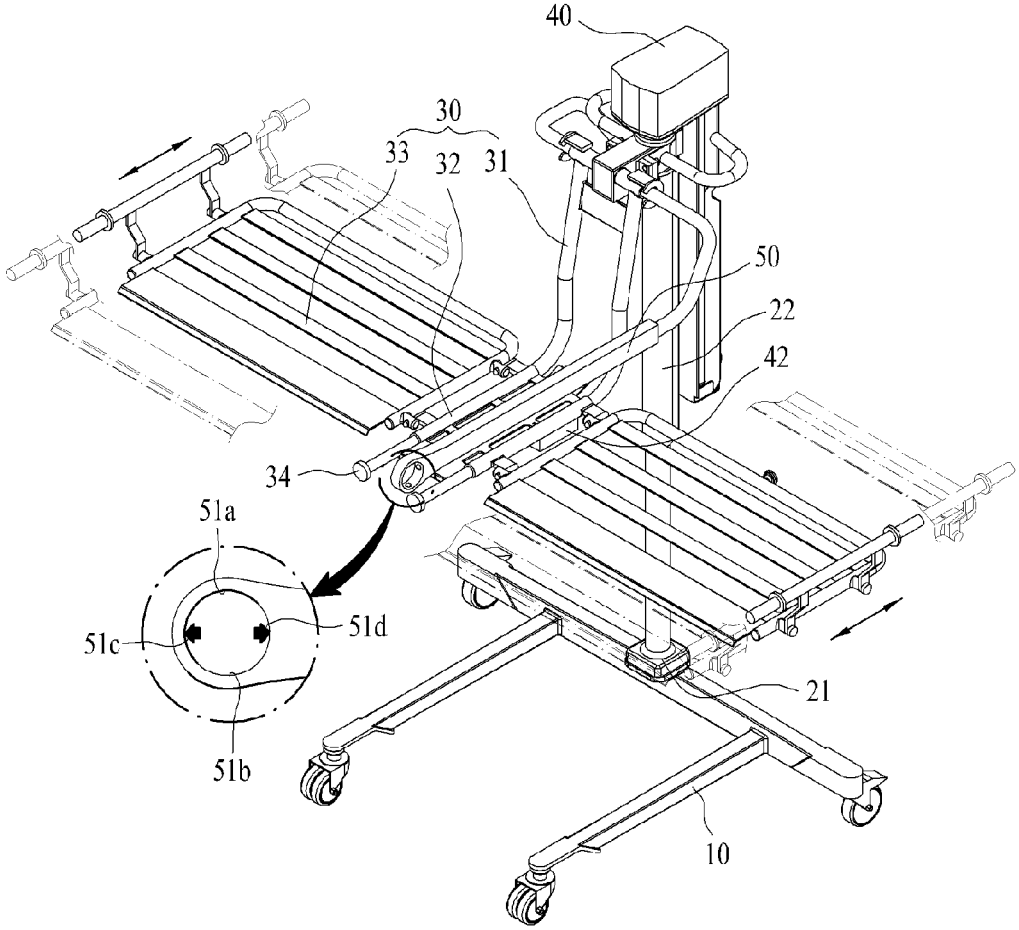
FIG. 7 is a perspective view illustrating a bed unit sliding in a back and forth direction based on control of an operation control part according to a second embodiment of the present invention.

FIG. 7 is a perspective view illustrating the bed part 33 sliding in a forward and backward direction based on the operation of the control part 51 according to the second embodiment of the present invention.

Meanwhile, in the second embodiment, the upward and downward movement of the movable member 22 according to the first embodiment shown in FIG. 4 may be applied identically. Referring to FIGS. 4 and 7, the second embodiment will be described as follows.

Referring to FIGS. 4 and 7, the structure and operation of the vertical direction movement according to the second embodiment is the same as the structure and operation thereof according to the first embodiment, which will be omitted accordingly.

The bed unit 30 includes a connecting member 31 connected to the movable member 22, a sliding member 32 slidingly coupled to the connecting member 31 in a forward and backward direction, and a bed part 33 fixed to the sliding member 32. That sliding-drive may be variable in various driving types. In this embodiment, the sliding drive may be Rack and Pinion which can convert a rotational motion into a rectilinear motion. A stopper 34 is formed in an end of the connecting member 31 to limit forward sliding motion of the sliding member 32.

The driving unit 40 moves the movable member 22 in a vertical direction and a second auxiliary driving unit 42 slides the sliding member 32 in a forward and backward direction thereof. The second auxiliary driving unit 42 is positioned below the sliding member 32.

As mentioned above, the second embodiment has two types of driving methods. The operation control part 51 includes four input means that consist of an upper input means 51*a*, a lower input means 51*b*, a front input means 51*c* and a rear input means 51*d*.

Specifically, as shown in FIG. 4, the upward and downward motion of the movable member 22 is corresponding to the upper input means 51*a* and the lower input means 51*d*. Accordingly, the user puts the finger on the upper input means 51*a* or the lower input means 51*b* to apply the pressure. The movable member 22, the bed unit 30 connected to the movable member 22 and the operation unit 50 are moved upwardly or downwardly by the pressure.

As shown in FIG. 7, the forward and backward sliding of the sliding member 32 is corresponding to the front input means 51*c* and the rear input means 51*d*. Accordingly, the user puts the finger on the front input means 51*c* or the rear input means 51*d* to apply the pressure. After that, the sliding member 32 is sliding forwardly and backwardly and the bed part 33 is moved forwardly and backwardly together.

Figure 8:
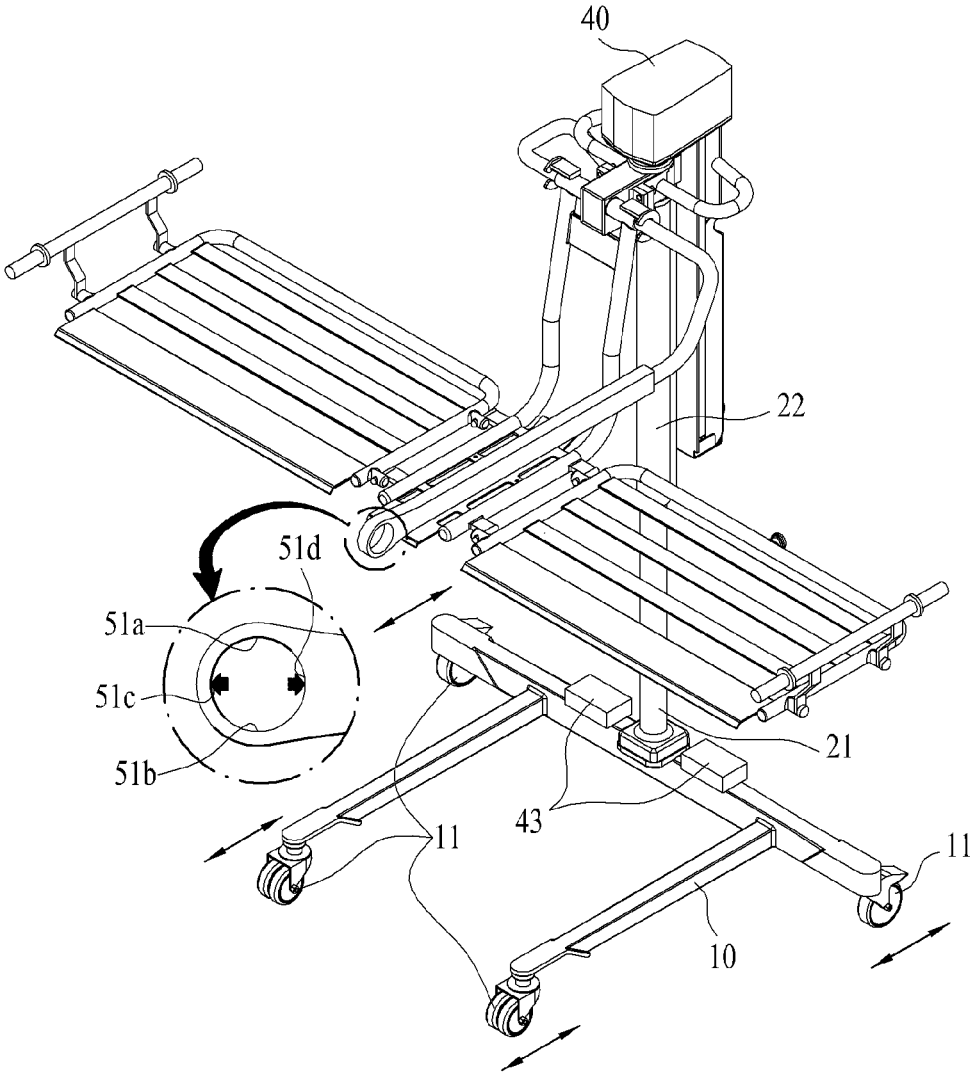
FIG. 8 is a perspective view illustrating a base frame moving a back and forth direction based on control of an operation control part according to a third embodiment of the present invention.

FIG. 8 is a perspective view illustrating the base frame 10 moving a back and forth direction based on control of an operation control part 51 according to a third embodiment of the present invention. Meanwhile, the structure and operation of the upward and downward motion according to the second embodiment is the same as the structure and operation of the upward and downward motion according to the first embodiment and will be omitted accordingly.

Referring to FIG. 8, a plurality of wheels 11 may be provided in the base frame 10 and the plurality of the wheels 11 may be rotated in a forward and reverse direction by a rotary motor. A driving unit 40 moves the movable member 22 upwardly and downwardly and a third auxiliary driving unit 43 rotates the plurality of the wheels 11. The third auxiliary driving unit 43 is positioned in the main support leg of the base frame 10.

The operation control part 51 according to the third embodiment includes four input means that consist of an upper input means 51*a*, a lower input means 51*b*, a front input means 51*c* and a rear input means 51*d*.

Specifically, in the third embodiment as shown in FIG. 4, the vertical movement of the movable member 22 is corresponding to the upper input means 51*a* and the lower input means 51*b*. Accordingly, the user puts the finger on the upper input means 51*a* or the lower input means 51*b* to apply the pressure. The movable member 22, the bed unit 30 connected to the movable member 22 and the operation unit 50 are moved upwardly or downwardly by the pressure.

As shown in FIG. 8, signals input from the front input mean 51*c* and the rear input means 51*d* are corresponding to the rotations in both directions performed by a shaft of the wheels 11, respectively. Accordingly, the user puts the finger on the front input means 51*c* or the rear input means 51*d* to apply the pressure. The base frame 10 is moved forwardly and backwardly by the rotation of the wheels 11 and the lift device 1 is moved forwardly and backwardly.

Figure 9:
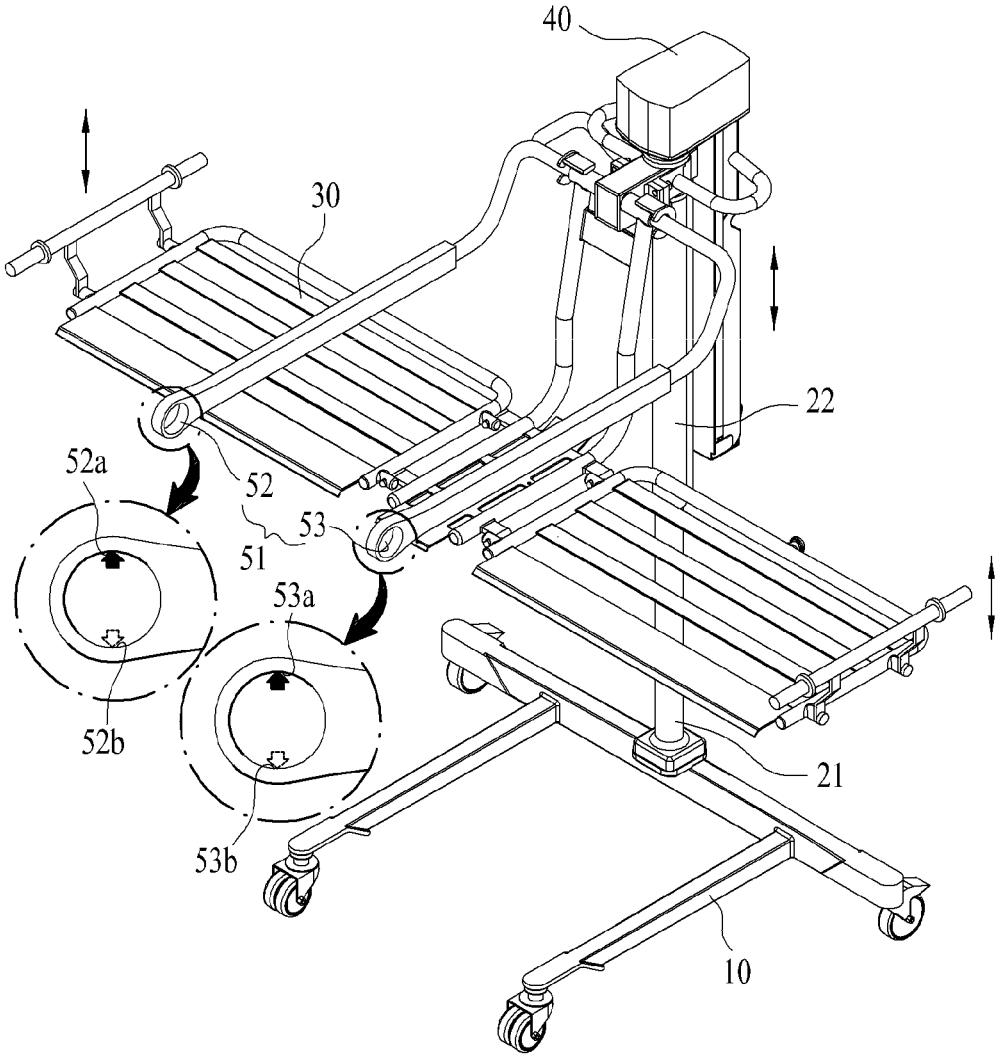
FIG. 9 is a perspective view illustrating a movable member moving in an up and down direction based on control of an operation control part according to a fourth embodiment of the present invention.
Figure 10:
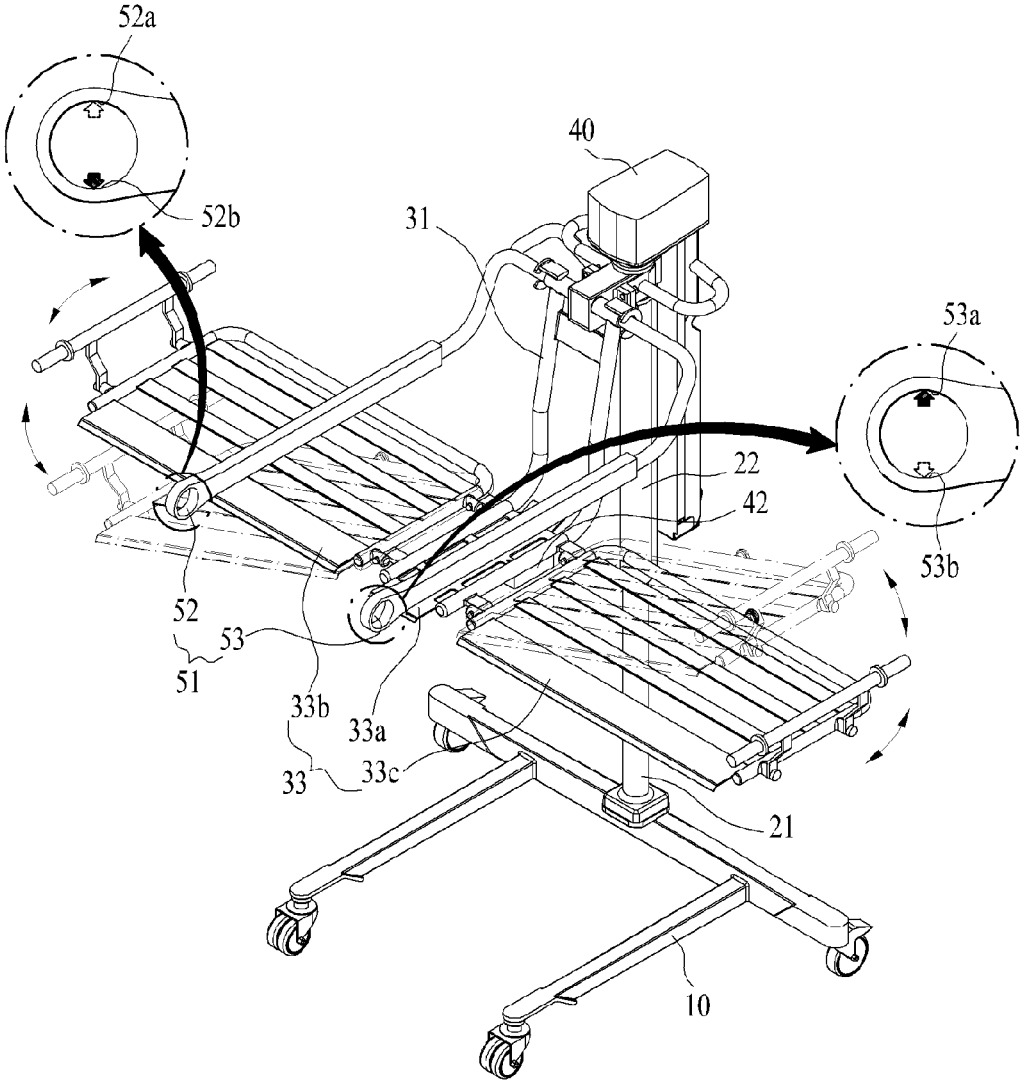
FIG. 10 is a perspective view illustrating a left bed part and a right bed part rotating with respect to a back and forth shaft.

FIG. 9 is a perspective view illustrating a movable member 22 moving in an up and down direction based on control of an operation control part 51 according to a fourth embodiment of the present invention. FIG. 10 is a perspective view illustrating a left bed part 33*b* and a right bed part 33*c* rotating with respect to a back and forth shaft.

Referring to FIGS. 9 and 10, the operation control part 51 according to the fourth embodiment includes a left operation part 52 and a right operation part 53. A plurality of input means may be provided in the left and right operation parts 52 and 53, respectively, to realize more driving methods than the driving methods of the first embodiment.

Meanwhile, the structure for the upward motion of the movable member 22 is the same as the structure of the first embodiment and it will be omitted accordingly.

The bed unit 30 includes a connecting member 31 connected to the movable member 22 and a bed part 33 fixed to the connecting member 31. The bed part 33 includes a main bed part 33*a*, a left bed part 33*b* rotatably coupled to a left side of the main bed part 33*a* with respect to a back and forth direction shaft, and a right bed part 33*c* rotatably coupled to a right side of the main bed part 33*a* with respect to a vertical direction shaft. This rotation is enabled by a rotary motor.

The operation control part 51 includes a left operation part 52 and a right operation part 53 spaced apart a predetermined distance from each other in a right and left direction, which is different from the embodiments mentioned above. The operation control part 51 is configured of the pair of the operation parts such that the user can put the fingers of both hands on the left operation part 52 and the right operation part 53, respectively, to operate the lift device 1. A plurality of input means may be provided in the pair of the operation parts 51, only to generate various input signals for realizing various drives of the lift device.

The driving unit 40 moves the movable member 22 vertically and a second auxiliary driving unit 42 rotates the let bed part 33*b* and the right bed part 33*c* with respect to a back and forth direction shaft. The second auxiliary driving unit 42 may drive the left bed part 33*b* and the right bed part 33*c*.

This embodiment has a driving type generated by the motion of the movable member 22 and the rotation of the left bed part 33*b* and the right bed part 33*c*. The left operation part 52 and the right operation part 53 have two input means that consist of an upper input means 52*a* and 53*a* and a lower input means 52*b* and 53*b*, respectively. The driving types mentioned above can be realized by the simultaneous operation Or independent operation of the left and right operation parts 52 and 53. Specifically, as shown in FIG. 9, when the user puts the upper input means 52*a* and 53*a* and the lower input means 52*b* and 53*b* to apply the pressure to them simultaneously, the movable member 22, the bed unit 30 connected to the movable member 22 and the operation unit 50 are moved upwardly or downwardly together.

As shown in FIG. 10, when the user puts the finger on the upper input means 52*a* or the lower input means 52*b* of the left operation part 52 to apply the pressure to them without operating the right operation part 53, the left bed part 33*b* is rotated with respect to the back and forth direction shaft. Also, when the user puts the finger on the upper input means 53*a* or the lower input means 53*b* of the right operation part 53 to apply the pressure to them without operating the left operation part 52, the right bed part 33*c* is rotated with respect to the back and forth direction shaft.

As mentioned above, the pair of the operation parts 51 may be realized and a driving type for distinguishing the simultaneous operation from the separate operation can be applied to the operation part 51. Accordingly, various operations may be realized advantageously.

Figure 11:
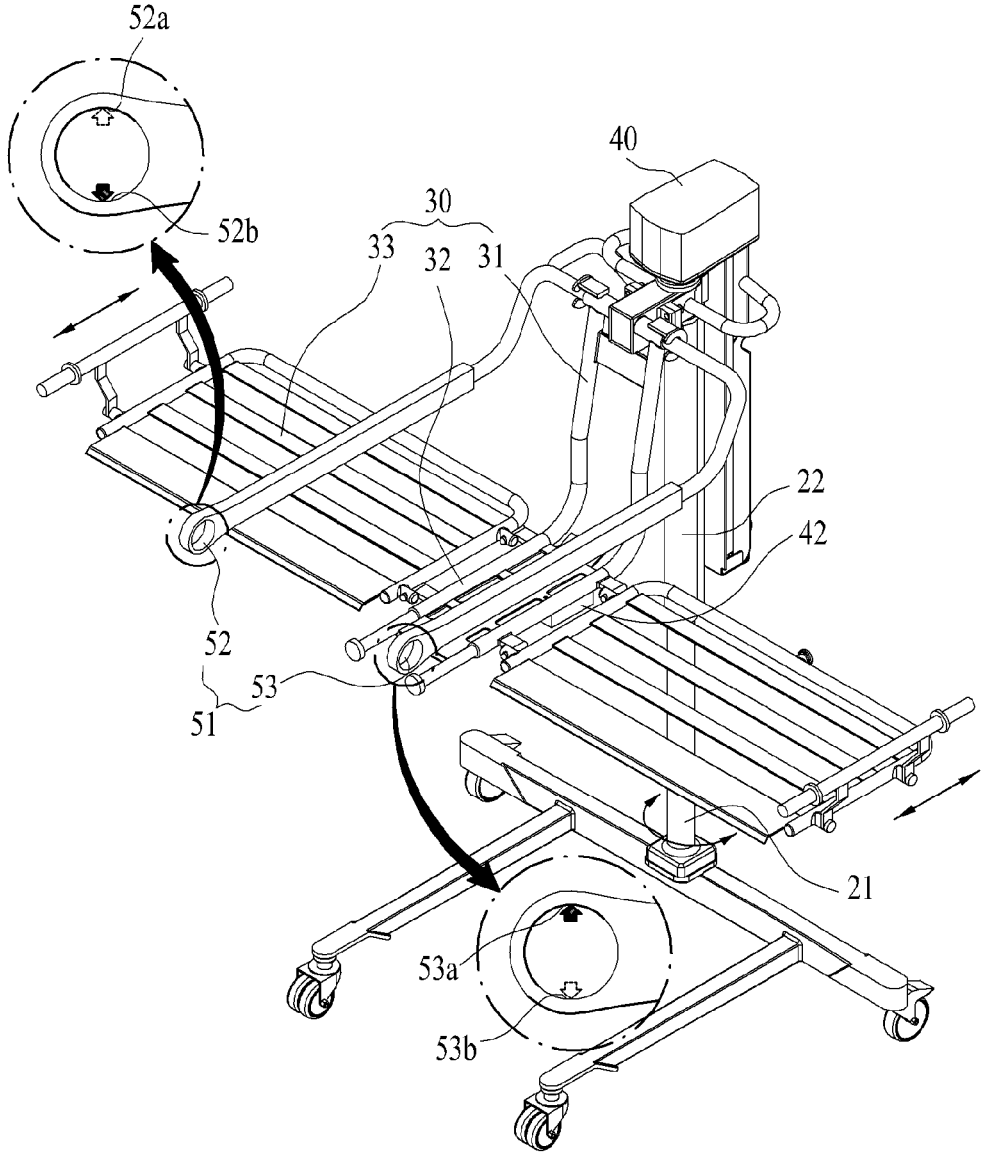
FIG. 11 is a perspective view illustrating a main frame rotating in a right and left direction with respect to a vertical shaft and a bed unit sliding in a back and forth direction, based on control of an operation control part according to a fifth embodiment of the present invention.

FIG. 11 is a perspective view illustrating a main frame 20 rotating in a right and left direction with respect to a vertical shaft and a bed part 33 sliding in a back and forth direction, based on control of an operation control part 51 according to a fifth embodiment of the present invention.

The same vertical motion of the movable member 22 according to the fourth embodiment may be applied to the fifth embodiment. A structure and operation of the vertical motion in the fifth embodiment is the same as the structure and operation according to the fourth embodiment and will be omitted accordingly as follows.

Specifically, in the fifth embodiment as shown in FIGS. 9 and 11, the vertical motion of the movable member 22 is corresponding to the upper input means 52*a* and 53*a* and the lower input means 52*b* and 53*b* provided in the left operation part 52 and the right operation part 53. The back and forth direction sliding of the sliding member 32 is corresponding to the upper input means 52*a* and the lower input means 52*b* of the left operation part 52. The right and left direction rotation of the fixing member 21 is corresponding to the upper input means 53*a* and the lower input means 53*b* of the right operation part 53.

Even in the fifth embodiment as shown in FIG. 9, the user puts the fingers on the upper input means 52*a* and 53*a* and the lower input means 52*b* and 53*b* of the left operation part 52 and the right operation part 53, respectively, to apply the pressure to them. In this instance, the movable member 22, the bed unit 30 connected to the movable member 22 and the operation unit 50 may be moved upwardly or downwardly together.

As shown in FIG. 11, when the user puts the finger on the upper input means 52*a* or the lower input means 52*b* of the left operation part 52 to apply the pressure, without operating the right operation part 53, the sliding member 32 is sliding in a back and forth direction and the bed part 33 is moved in the back and forth direction together. Also, when the user puts the finger on the upper input means 53*a* or the lower input means 53*b* of the right operation part 53 to apply the pressure, without operating the left operation part 52, the fixing member, the movable member 22 connected to the fixing member 21 the bed unit 30 and the operation unit 50 are rotated in a right and left direction together.

Even in case of various diving methods, the pair of the operation control parts 51 is provided to distinguish the simultaneous and separate operations from each other to enable smooth operation. When the front input means and the rear input means are provided in the left operation part 52 and the right operation part 53 which will be described later, signals for various driving methods of the lift device can be combined.

Figure 12:
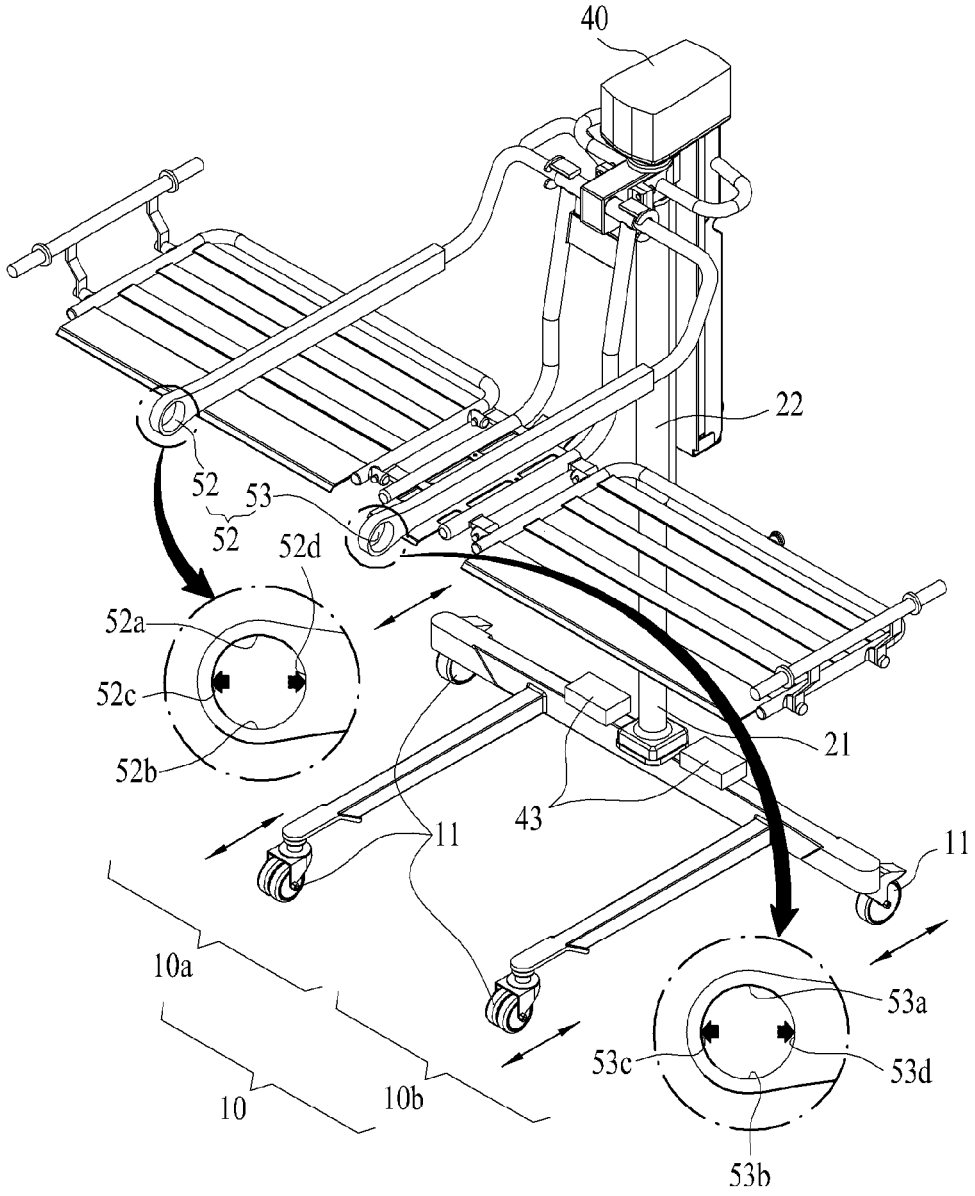
FIG. 12 is a perspective view illustrating a left moving part and a right moving part that are moving in a back and forth direction based on control of an operation control part according to a sixth embodiment of the present invention.

FIG. 12 is a perspective view illustrating a left moving part and a right moving part that are moving in a back and forth direction based on control of an operation control part according to a sixth embodiment of the present invention.

Meanwhile, even in the sixth embodiment, the structure and operation for the upward and downward motion of the movable member 22 according to the fourth embodiment shown in FIG. 8 is the same as the fourth embodiment shown in FIG. 8 and will be omitted accordingly.

Referring to FIG. 12, the base frame 10 includes a left moving part 10*a* and a right moving part 10*b* having a plurality of wheels 11, respectively. The plurality of the wheels 11 may be rotated in a forward and reverse direction by a rotary motor.

Also, the driving unit 40 moves the movable member 22 in an up and down direction and the third auxiliary driving unit 43 rotates the plurality of the wheels 11 provided in the left moving part 10*a* and the right moving part 10*b*. The third auxiliary driving unit 43 is positioned in a main support leg of the base frame 10.

The left operation part 52 and the right operation part 53 include fourth input means that consist of upper input means 52*a* and 53*a*, lower input means 52*b* and 53*b*, the front input means 52*c* and 53*c* and rear input means 52 and 53*d*.

Specifically, in the sixth embodiment as shown in FIGS. 9 and 12, the upper input means 52*a* and 53*a* and the lower input means 52*b* and 53*b* of the left operation part 52 and the right operation part 53 may be corresponding to the vertical motion of the movable member 22. The driving of the wheels 11 provided in the left moving part 10*a* may be corresponding to the front input means 52*c* and the rear input means 52*d* of the left operation part 52.

Accordingly, the user puts the fingers on the upper input means 52*a* and 53*a* and the lower input means 52*b* and 53*b* of the left and right operation parts 52 and 53 to apply the pressure to them simultaneously. In this instance, the movable member 22, the bed unit 30 connected to the movable member 22 and the operation unit 50 are moved upwardly or downwardly.

When the user puts the fingers the front input means 52*c* or the rear input means 52*d* of the left operation part 52 to apply the pressure, the left moving part 10*a* is moved in the back and forth direction by the rotation of the wheels 11. Also, when the user puts the fingers on the front input means 53*c* or the rear input means 53*d* of the right operation part 53 to apply the pressure, the right moving part 10*b* is moved in the back and forth direction by the rotation of the wheels 11. Accordingly, when inputting signals to the front input means 52*c* and 53*c* or the rear input means 52*d* and 53*d* of the left operation part 52 and the right operation part 53 simultaneously, the lift device 1 may be moved forwardly or backwardly. When the left operation part 52 or the right operation part 53 is operated, it may be possible to turn the lift device 1 in a left or right direction.

The driving generated by the sliding member 32 and the rotation of the fixing member 21 according to the fifth embodiment may include the driving generated by the left bed part 33*b* and the right bed part 33*c* of the fourth embodiment.

According to the first to sixth embodiments described above, the present invention may be varied by the various driving methods, the number of the operation control parts 51 and the input means, the driving methods corresponding to the input means and the simultaneous or separate operation. The driving methods according to the embodiments may be combined with each other or a new driving method or operation method can be further provided. The various driving methods using the motor and the like described according to the first to sixth embodiments may be one of examples adapted by the present invention. Anyone skilled in the air to which the present invention pertains can expect various types of driving methods.

Meanwhile, even when the present invention is embodied via various embodiments, there is no change in providing the driving method considering the convenient and intuitive usage and safety of the human body.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A lift device comprising:

a base frame;

a main frame comprising a fixing member longitudinally formed in an up and down direction, coupled to the base frame, and a movable member movably provided in an up and down direction;

a bed unit connected to the movable member, positioned in front of the main frame;

an operation unit having an end connected to the movable member or the bed unit and the other end extended forwardly, with a ring-shaped operation control part provided in the other end thereof to put a user's finger thereon; and a driving unit configured to move the movable member upwardly based on input of the operation control part, wherein the operation control part comprises an upper input means positioned in an inner top surface thereof to upwardly move the movable member based on an input signal and a lower input means position in an inner bottom surface thereof to downwardly move the movable member based on an input signal, wherein the upper input means and the lower input means include a strain gauge respectively which measures an electrical resistance value of the strain gauge itself based on an external pressure applied by the user's finger and a driving speed of the main driving unit is varied according to the electrical resistance value measured.

2. The lift device according to claim 1, further comprising a first auxiliary driving unit configured to rotate the main frame, wherein the main frame is rotatably coupled to the base frame with respect to an up and down direction shaft, and the operation control part comprises a front input means positioned in an inner front surface thereof to rotate the main frame in a left or right direction based on an input signal and a rear input means positioned in an inner rear surface thereof to rotate the main frame in the reverse direction of the rotational direction corresponding to the front input means based on an input signal.

3. The lift device according to claim 1, wherein the bed unit comprises, a connecting member connected to the movable member;

a sliding member slidingly coupled to the connecting member in a longitudinal direction thereof;

a bed part fixed to the sliding member, and a second auxiliary driving unit configured to slide the sliding member, and the operation control part comprises, a front input means positioned in an inner front surface thereof to slide the sliding member forwardly based on an input signal; and a rear input means positioned in an inner rear surface thereof to slide the sliding member backwardly based on an input signal.

4. The lift device according to claim 1, wherein the base frame comprises a plurality of wheels, and a third auxiliary driving unit configured to rotate the plurality of the wheels, and the operation control part comprises a front input means positioned in an inner front surface thereof to forwardly move the base frame based on an input signal; and a rear input means positioned in an inner rear surface thereof to backwardly move the base frame based on an input signal.

5. The lift device according to claim 1, wherein the operation control part comprises a pair of left and right operation parts spaced from each other in a right and left direction, and when signals are input to the upper input means of the left operation part and the right operation part simultaneously, the movable member is upwardly moved, and when signals are input to the lower input means thereof simultaneously, the movable member is downwardly moved.

6. The lift device according to claim 5, wherein the bed unit comprises, a connecting member connected to the movable member and a bed part fixed to the connecting member, and the bed part comprises, a main bed part fixed to the connecting member;

a left bed part rotatably coupled to a left side of the main bed part; and a right bed part rotatably coupled to a right side of main bed part, and a second auxiliary driving unit configured to rotate the left bed part and the right bed part, and the left bed part is rotated in an up and down direction based on input of an upper input means or lower input means of the left operation part, and the right bed part is rotated in the up and down direction based on input of an upper input means or lower input means of the right operation part.

7. The lift device according to claim 5, wherein the main frame is rotatably coupled to the base frame with respect to an up and down direction shaft, and the bed unit comprises a connecting member connected to the movable member; a sliding member slidingly coupled to the connecting member in a longitudinal direction thereof; and a bed part fixed to the sliding member, and a first auxiliary driving unit configured to rotate the main frame and a third driving part configured to slide the sliding member, and the main frame is rotated in a right or left direction based on a signal input to an upper or lower input means provided in one of left and right operation parts, and the sliding member is sliding in a back and forth direction based on a signal input to an upper or lower input means provided in the other one of the left and right operation parts.

8. The lift device according to claim 5, wherein the base frame comprises a left moving part and a right moving part having a plurality of wheels, respectively, and a fifth auxiliary driving unit configured to rotate the plurality of the wheels provided in the left moving part or the right moving part, and the left operation part and the right operation part comprise front input means positioned in inner front surfaces of the left and the right operation parts, respectively, and rear input means positioned in inner rear surfaces of the left and right operation parts, respectively, and the left operation part is forwardly or backwardly moved based on a signal input to the front or rear input means of the left operation part, and the right operation part is forwardly or backwardly moved based on a signal input to the front or rear input means of the right operation part.

* * * * *